United States Patent [19]

Riehle

[11] Patent Number: 4,538,055

[45] Date of Patent: Aug. 27, 1985

[54] SLIDE RULE

[76] Inventor: Harald Riehle, Anna-Schieber-Weg 13, D-7300 Esslingen, Fed. Rep. of Germany

[21] Appl. No.: 678,390

[22] Filed: Dec. 7, 1984

Related U.S. Application Data

[63] Continuation of Ser. No. 447,723, Dec. 7, 1982, abandoned.

[30] Foreign Application Priority Data

Dec. 7, 1981 [DE] Fed. Rep. of Germany ..... 3148355

[51] Int. Cl.[3] ..... G06G 1/02

[52] U.S. Cl. ..... 235/70 R; 235/78 R; 235/88 R

[58] Field of Search ..... 235/70 R, 84, 78 R, 235/78 A, 78 F, 78 G, 78 M, 78 N, 78 RC, 88 R–88 RC, 89 R

[56] References Cited

U.S. PATENT DOCUMENTS 3,539,781 11/1970 Pryor ..... 235/70 R X
4,262,739 4/1981 Schoettle, Jr. ..... 235/70 R X

FOREIGN PATENT DOCUMENTS 2032662 5/1980 United Kingdom ..... 235/78 R

*Primary Examiner*—L. T. Hix
*Assistant Examiner*—Della Rutledge
*Attorney, Agent, or Firm*—Jones, Tullar & Cooper

[57] ABSTRACT

A slide-rule is obtained by superpositioning and connecting three plates (1, 2, 3) into the middle one of which slots (20, 21) are milled, and thereafter cutting off the boundary areas (5, 6, 7, 8), including the boundary areas (5, 6) of the middle plate (2), into which the slots (20, 21) do not extend.

8 Claims, 12 Drawing Figures

SLIDE RULE

This is a continuation of application Ser. No. 447,723 filed on Dec. 7, 1982 now abandoned.

TECHNICAL FIELD

The invention relates to a slide-rule comprising an upper cover plate, a lower cover plate and a slide positioned between the cover plates, and further surrounded at both sides by guide members.

BACKGROUND OF THE INVENTION

Slide rules comprising an upper cover plate, a lower cover plate, side guide members and a slide positioned between the cover plates and the guide members are known. With a known method for producing such slide-rules, the guide members are glued to the lower cover plate. Thereafter the upper cover plate is glued to the guide members and the structure, in which the slide is guided, is thus obtained. Even though resulting in a simple construction of the slide-rule, this construction requires some time and still, since in order to maintain parallelism of the guide members and keep the exact required distance of the same, special gauge means are necessary when connecting the guide members to the cover plates. It is also known to construct slide-rules by cutting two parallel lines with a knife or the like into a card board plate; the cutting lines thereby do not fully separate the plate. Thereafter, the plate is connected to an upper and a lower cover plate and the boundary areas, which include the portions still connecting the guide members and slide, are cut off.

With this type of production, no adjustment steps or means are necessary; however, by the cutting action oblique surfaces with burs are generated. Some material along these obliquely cut edges is displaced and results in a bow or vault along the edges. It is not possible to obtain rectangularly cut surfaces opposing each other as required for accurate sliding of the slide on the surfaces of the guide members. The parallelism of the guide surfaces isn't accurate enough. As a consequence of the obliqueness of the side surfaces - especially when the slides are of broader width - a danger exists that the slide slips or moves between the guide members and the cover plates. This means that the guidance of the slide and the accuracy of reading the scales on the cover plates is largely deteriorated. Further, with this procedure one can only produce slide-rules of paper board. If the mentioned process is applied to plastic foil or sheets, the bows or vaults generated by the displacement of material along the cutting edges will become too large.

A further procedure is known from German Pat. No. 22 54 387. It provides that the cover plates are connected between two connecting rails, which serve as guide members and which are generally E-shaped. The middle flanges at the E-shaped rail serve as the guides of the slide. This method provides precisely guided slides; however, it requires a certain effort during production and therefore is too time consuming.

SUMMARY OF THE INVENTION

It is the object of the present invention to provide a slide-rule, with which the slide member and the guide members for guiding the slide member can be as simple as possible and produced from one part only; it is a further object of the present invention to avoid the disadvantages of the state of the art, especially with respect to the accuracy of guiding the slide.

It is a further object of the present invention that a slide member of the type mentioned above can be easily and rationally produced; such production also shall be possible from other materials than paper board, especially from plastic or metal blank sheets.

Further, it is an object of the present invention, that a particular adjustment of the cover plates, the guide members and the slide is not necessary.

Further, it is an object of the present invention that one can easily select a predetermined clearance between the guide members and the slide.

These objects are achieved in accordance the invention by providing within a plate slots of a predetermined width and with rectangular surfaces, which are parallel to each other and spaced from each other by a certain defined distance. This plate is connected with the upper and the lower cover plates and thereafter the boundary areas of the cover plate and the slotted plate are cut off. By providing within a plate parallel slots with accurately rectangular and spaced surfaces, it is possible to attain a very accurate guiding mechanism of the slide within the guide members; at the same time a predetermined clearance can be selected by selecting the distance between the side surfaces of the slots, i.e. the width of the slots. The guidance of the slide between the guide members still can be improved, when a lubricating agent is held by the roughness of the surfaces of the slots.

The slot is not provided by cutting action, since this would practically squeeze the material and therefore result in oblique surfaces and a displacement of the material mentioned above, as it is the case with the prior art. It is rather important that the slot is provided in such a manner that rectangular and parallel side surfaces result, which are spaced from each other by a predetermined distance. Preferably this is attained by chip removal, as e.g. by milling with circular saw blades.

It is possible, by using the invention, to make the guide members and the slide from plastic or metal sheets. This leads to simple mass production with materials, with which this has not yet been possible. The connection of the plate, from which the slide and the guide members are made, with the upper and the lower cover plates can be attained by glueing, by high frequency or ultrasonic welding and/or by rivetting. When metal is used, the connection also can be made by point-welding.

The principle of this invention also can be used with slide-rules of the rotatable disc type. Such a slide-rule comprises an upper cover plate, a lower cover plate, and a round disc received rotatably between the cover plates and further received within a recess in a guide member of corresponding circular form.

The invention provides in this respect that the slide-rule is produced by producing the disc and the guide member from a plate by providing this plate with a slot, which has the form of a full circle - with the exception of a small bridging portion closed to one edge of the plate. Further, both cover plates also are provided with slots, which extend from the edges in the direction of the disc beyond the bridging portion of the first mentioned plate; additionally, these slots are separated from the edges of the plates, from which they extend into the interior of the same, also by little bridge portions. The slide-rule then is formed in a manner per se known in the art by connecting the first mentioned plate with both cover plates; subsequently, the boundary portions, within which the bridging portion is provided, are simply cut off, whereby the disc is made rotatable within the guide member.

In addition to the same advantages mentioned above, namely accurate guidance of the rotating disc within the guide member, it is no longer necessary to connect the center of the disc to the cover plates by means of a shaft or a hollow rivet. Centering of the disc is achieved without such connection solely by the exact correspondence of the recess in the guide member to the disc.

These and other advantages of the invention will become clear from the subsequent description of various embodiments by means of the enclosed drawings. The drawings represent:

DETAILED DESCRIPTION

Figure 1A:
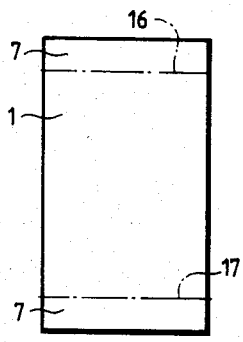
FIGS. 1*a*, 1*b*, 1*c*, illustrate, in plan view, three plates used in constructing the slide-rule according to a first embodiment of the present invention.
Figure 1B:
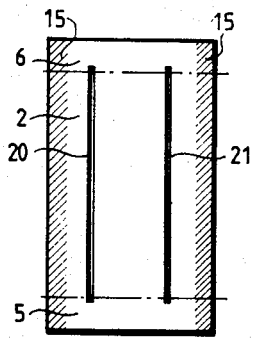
Figure 1C:
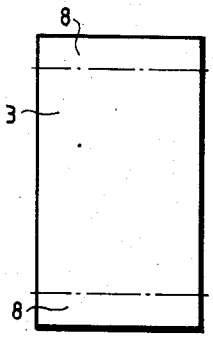
Figure 3:
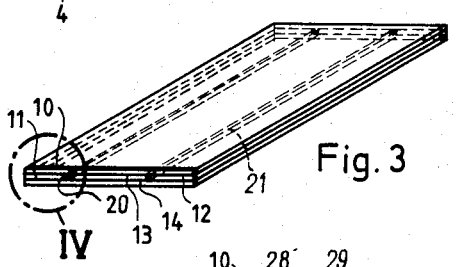
FIG. 3, is a perspective view of the slide-rule according to a first embodiment of the present invention.

For the production of a slide-rule shown in FIG. 3, three plates as shown in FIG. 1*a*, 1*b* and 1*c* are provided. Plate 1 is for later obtaining the upper cover plate 10 of the slide-rule, plate 2 is for later obtaining the guide strips 11, 12 and the slide 13; plate 3 is for later obtaining the lower cover plate 14.

The slide-rule in accordance to FIG. 3 consists of upper cover plate 10, guide strips 11, 12, a slide member or slide tongue 13 (hereinafter referred to simply as slide) and lower cover plate 14. In the slide-rule, the guide strips 11, 12 will be arranged on both sides of slide 13 and the guide strips 11, 12 will be connected to upper cover plate 10 and lower cover plate 14 for example by glueing. The slide 13 then is freely movable between the cover plates 10, 14 and between guide strips 11, 12. The cover plates and the slide are carrying scales, the relative movement of which can be observed through a window in the cover plate. For purposes of simplification, however, this is not shown in the present drawings.

Slots 20 and 21 in plate 2 are made such that after connecting plates 1, 2, 3 together and thereafter cutting off the unslotted boundary areas 5, 6 of plate 2 and further boundary areas 7 and 8 of plates 1 and 3 along lines 16 and 17, the sliderule results. Also guide strips 11, 12 are made to be separate from slide 13.

First, plates 1, 2 and 3, as shown in FIG. 1*a*, 1*b* and 1*c*, are positioned over each other. The lowest plate is plate 3; on plate 3, plate 2 is positioned; on plate 2, plate 1 is positioned. Thereafter, plates 1 and 2, as well as plates 2 and 3 will be glued to each other, after glue has been deposited on the hatched areas 15. Thereafter, the composite structure, obtained thereby is cut along dash-dotted lines 16 and 17.

Figure 2:
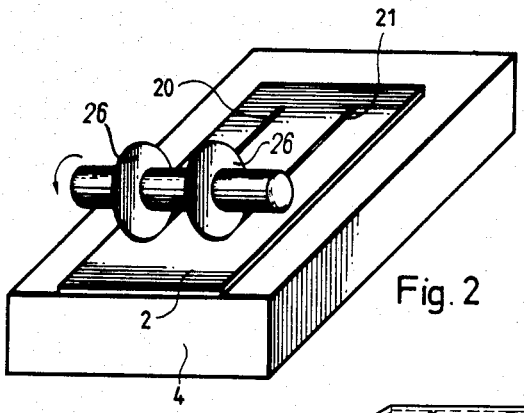
FIG. 2, is a schematic illustration of an assembly for producing the plate of FIG. 1*b*.

The slots 20 and 21 are milled into plate 2 as shown schematically in FIG. 2 by means of thin cross-saw-blades 26, driven by a rotating spindel (not shown).

Figure 4:
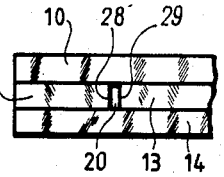
FIG. 4, is an enlarged view of area IV of FIG. 3.

During this process plate 2 is held on plate 4 and plate 4 is moved relative to the circular saw-blades 26 such that slots 20 and 21 are generated. The circular saw-blades 26 for example may have a thickness of 0.1 mm. Correspondingly the width of the slots as milled by blades 26 into plate 2, also is 0.1 mm. It is also possible to have e.g. widths of 0.15 or 0.2 mm. This depends on what clearance one would like to have between the guidance strips 11, 12 and slide 13. Thereby, one obtains exact guidance of the slide 13; especially exact parallelism of the edges of guiding strips 11, 12 and slide 13 is obtained. Further, one obtains sufficient clearance between slide 13 and guiding strips 11, 12, such that the slide 13 is easily movable between the guide strips 11, 12. This manner of providing slots 20, 21 also guarantees that the side surfaces 28 and 29 (see FIG. 4) of the slots are exactly normal to the surface of the plate, into which they are milled. By the shown way of producing the slots, also a certain roughness of the side surfaces 28, 29 is obtained such that a lubricating agent, like e.g. Vaseline, can easily be received by the unevenesses of the rough surfaces and held over along period of use.

It is essential for the shown method of production and the product resulting therefrom that the slots 20, 21 have exactly parallel and plane side surfaces 28, 29 and that the guide strips 11, 12 will also be automatically positioned exactly parallel to each other and to the edges of the slide 13 without the need of any type of adjustment. Thus, one obtains a highly precise slide-rule.

Alternatively the slots may be provided by the dislocation of the material by means of laser or electron beams. The connection of plates 1, 2, 3 also can be achieved by other means, like e.g. welding, screwing or rivetting. As a material for plates 1, 2, 3 preferably plastic foils or plastic plates are use; however, it is also possible to use metal, card board, paper board etc.

Figure 6A:
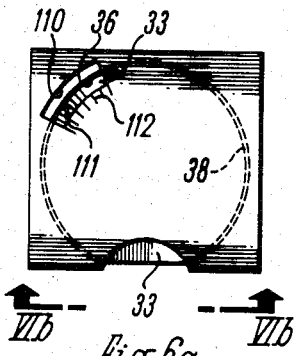
FIG. 6*a*, illustrates a top view of the slide-rule according to a second embodiment of the present invention.
Figure 6B:
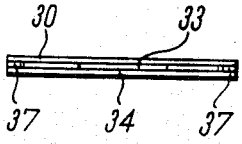
FIG. 6*b*, illustrates a front view of the slide-rule according to a second embodiment of the present invention.
Figure 7:
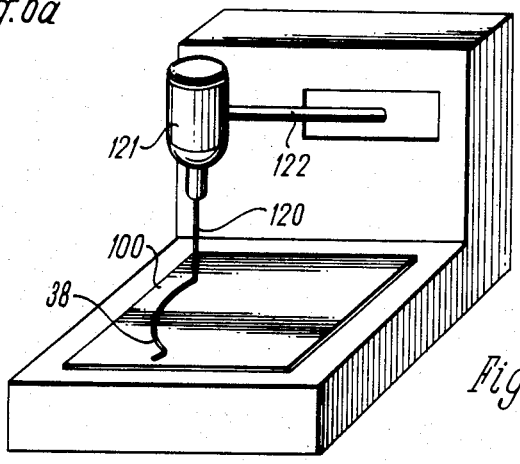
FIG. 7, is a schematic illustration of an assembly for producing the plate of FIG. 5*b*.

FIGS. 5 to 7 show a second embodiment. It relates to a slide-rule of the rotating disc type, in which a disc 33 is used, which is rotated and thereby has the function of the member of the slide-rule. The rotating disc 33 is positioned between upper cover plate 30 and lower cover plate 34; the disc 33 further is rotatably received within guide member 37, which is provided for this purpose with a recess 36, the round form of which corresponds to the form of disc 33.

Figure 5A:
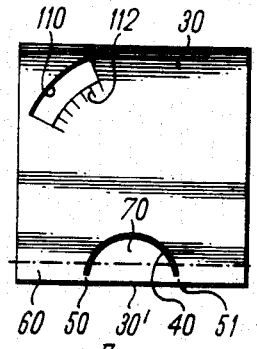
FIG. 5*a*, 5*b*, 5*c*, illustrates, in plan view, three plates used in constructing the slide-rule according to a second embodiment of the present invention.
Figure 5B:
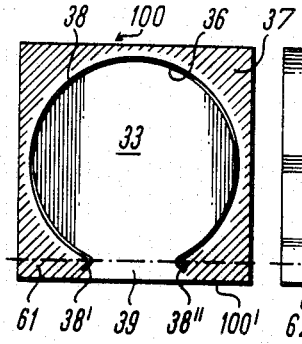
Figure 5C:
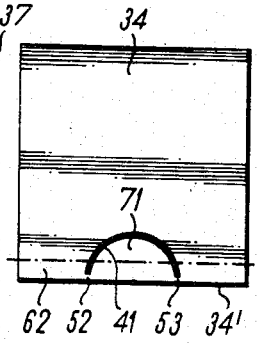

For producing this slide-rule, first three plates shown in FIGS. 5*a* to 5*c* are made.

Plate 100, shown in FIG. 5*b*, is provided with a slot 38; this slot has the form of a full circle with the exception of the bridging portion 39 near edge 100′ of plate 100. The ends 38′, 38″ of the slot 38 are V-shaped as shown. Now, if one cuts plate 100 along the shown dash-dotted line to separate the boundary area 61 therefrom, one obtains as parts movable relative to each other the guide member 37 and disc 33. It may be noted that disc 33 is not completely round along that portion, along which the bridging portion 39 has been cut off. However, this is not of relevance.

Cover plate 30 is shown in FIG. 5*a*. It is provided with a semi-circular slot 40, which extends closely to edge 30′ that two bridging portions 50 and 51 remain unslotted. They are, however, narrower than the distance of the already mentioned dash-dotted line from edge 30. This results in the following fact: if the plate 30 is cut along the dash-dotted line and thereby the boundary area 60 is cut off, the semi-circular portion 70 will be removed from the remaining plate 30. Plate 34 is formed in the same manner; see FIG. 5*c*.

After plate 30, 100, and 34, as shown in FIGS. 5*a* to 5*c*, have been produced, they are glued to each other. The upper cover plate 30 is placed on top, followed by plate 100, which is placed below the same, which is followed by lower cover plate 34. For this purpose the hatched area of plate 100 will be covered with glue or some other adhesive. Subsequently the plates are pressed against each other and allowed to form a permanent connection.

Thereafter, the composite structure obtained by the connection of plates 30, 100, 34 is cut along the dash-dotted line. One thereby obtains the slide-rule in accordance with FIGS. 6*a* and 6*b*. The boundary area 60 of cover plate 30, the boundary area 61 of plate 100 and the boundary area 62 of plate 34 thereby are removed as well as the semi-circular portions 70 or 71 of plates 30 and 34. Disc 33 is accessible from the front and can easily be rotated.

The upper cover plate 30 may have a window 110. Through this the rotation of disc 33 with scale 111 relative to cover plate 30 and scale 112 provided thereon can be observed.

FIG. 7 shows schematically the production of plate 100, i.e. the milling of a slot 38 into it by means of a copying milling machine. With this machine, a graving or milling tool 120 is provided, which is driven by a unit 121. This driving-unit is provided on an arm 122, which is moved by means of an automatic control mechanism (not shown) along a programmed path, which results in the desired circular form of slot 38. Such machines can be obtained in commerce; it therefore is not necessary to describe them in more detail.

For the embodiment of FIG. 5 to FIG. 7, it also is essential and it is guaranteed by the way of producing slot 38, that the side surfaces of the slot thereby are exactly parallel to each other and normal to the larger surfaces of the plates, into which the slot is cut.

I claim:

1. A slide-rule comprising an upper cover plate, a lower cover plate a pair of spaced apart guide strips and a plastic slide plate situated between the upper and lower cover plates and the guide strips such that the slide plate and the guide strips define parallel slots of a predetermined width, said plastic slide plate having parallel flat surfaces and said upper cover plate and said lower cover plate having at least one flat surface which engages a respective one of the parallel flat surfaces of said slide plate, said slide-rule being made by the process comprising the steps of:

forming spaced parallel slots of substantially equal length in the plastic slide plate by a milling or sawing blade, such that the side surfaces of each slot are perpendicular to the parallel flat surfaces of the slide plate and the width of each slot is equal to the width of the milling or sawing blade;

attaching the upper cover plate and the lower cover plate to a respective one of the parallel flat surfaces of the slide plate at those portions of said parallel flat surfaces situated between the spaced parallel slots and the respective edge of the slide plate; and cutting the assembly of the upper cover plate, the lower cover plate and the slide plate adjacent both edges perpendicular to the spaced parallel slots forming thereby the guide strips for the slide plate, such that the portion of the slide plate between said slots is slideable relative to the upper cover plate, the lower cover plate and the guide strip's.

2. The slide-rule according to claim 1, wherein each slot is formed to a width of approximately 0.05 to 0.2 mm.

3. The slide-rule according to claim 1, wherein each slot is formed to a width of approximately 0.1 mm.

4. The slide-rule according to claim 1, wherein each side surface of each slot is formed with a degree of roughness sufficient to receive lubrication.

5. The slide-rule according to claim 1, wherein the cover plates are plastic.

6. A slide-rule comprising an upper cover plate, a lower cover plate, a guide member and a plastic circular disc situated between the upper and lower cover plates and adjacent to the guide member such that the circular disc and the guide member define a circularly directed slot of predetermined width, said plastic circular disc having parallel flat surfaces and said upper cover plate and said lower cover plate having at least one flat surface which engages a respective one of the parallel flat surfaces of said circular disc, said slide-rule being made by the process comprising the steps of:

forming a circularly directed slot in the plastic circular disc by a milling or sawing blade; such that the side surfaces forming said slot are perpendicular to the parallel flat surfaces of the circular disc and the width of the slot is equal to the width of the milling or sawing blade, said slot including two ends terminating adjacent one edge of the circular disc; attaching the upper cover plate and the lower cover plate to a respective one of the parallel flat surfaces of the circular disc at those portions of the said parallel flat surfaces situated between the slot and outer edges of the circular disc; and cutting the assembly of the upper cover plate, the lower cover plate and the circular disc parallel to said edge and along a plane including the ends of said slot forming thereby the guide member for the circular disc, such that the portion of the circular disc within the slot is rotatable relative to the upper cover plate, the lower cover plate and the guide member.

7. The slide-rule according to claim 6, wherein the side surfaces of the slot are formed with a degree of roughness sufficient to receive lubrication.

8. The slide-rule according to claim 6, wherein the cover plates are plastic.

* * * * *